US005788783A

United States Patent [19]

Coutu et al.

[11] Patent Number: 5,788,783

[45] Date of Patent: Aug. 4, 1998

[54] IRON-NICKEL ALLOY FOR STRETCHED SHADOW MASK

[75] Inventors: Lucien Coutu; Georges Couderchon, both of Sauvigny les Bois; Jacques Baudry, Imphy, all of France

[73] Assignee: Imphy S.A., Puteaux, France

[21] Appl. No.: 683,815

[22] Filed: Jul. 18, 1996

[30] Foreign Application Priority Data

Jul. 18, 1995 [FR] France ..... 95 08642

[51] Int. Cl.[6] ..... H01F 1/147

[52] U.S. Cl. ..... 148/312; 312/402; 312/407; 420/459

[58] Field of Search ..... 148/312; 420/441, 420/458, 459, 460; 313/402, 407

[56] References Cited

U.S. PATENT DOCUMENTS

| | | | |
|---|---|---|---|
| 2,990,277 | 6/1961 | Post et al. . | |
| 3,269,834 | 8/1966 | Lykens et al. . | |
| 4,929,864 | 5/1990 | Tong | 148/254 |
| 5,028,836 | 7/1991 | Hirasawa | 313/402 |
| 5,399,939 | 3/1995 | Greenberg et al. | 315/85 |

FOREIGN PATENT DOCUMENTS

| | | |
|---|---|---|
| A-2 081 632 | 12/1971 | France . |
| A-43 36 882 | 11/1994 | Germany . |
| 1-264143 | 10/1989 | Japan . |
| 4-214832 | 8/1992 | Japan . |
| 6-279901 | 10/1994 | Japan . |

*Primary Examiner*—John Sheehan

*Attorney, Agent, or Firm*—Oblon, Spivak, McClelland, Maier & Neustadt, P.C.

[57] ABSTRACT

An iron-nickel alloy useful for the manufacture of a stretched shadow mask, the chemical composition of the iron-nickel alloy containing by weight: $69\% \leqq Ni \leqq 83\%$, $0\% \leqq Mo \leqq 7\%$, $0\% \leqq Cu \leqq 8\%$, $0\% \leqq Co \leqq 1.5\%$, $0\% \leqq W \leqq 7\%$, $0\% \leqq Nb \leqq 7\%$, $0\% \leqq V \leqq 7\%$, $0\% \leqq Cr \leqq 7\%$, $0\% \leqq Ta \leqq 7\%$, $0\% \leqq C \leqq 0.1\%$, $0\% \leqq Mn \leqq 1\%$, $0\% \leqq Si \leqq 1\%$, $0\% \leqq Ti \leqq 1.2\%$, $0\% \leqq Al \leqq 1.2\%$, $0\% \leqq Zr \leqq 1.2\%$, $0\% \leqq Hf \leqq 1.2\%$, $S \leqq 0.010\%$ the balance being iron and impurities resulting from smelting, the chemical composition furthermore satisfying the relationships:

$$Co+ni+1.5\times Cu \geqq 79.5\%;\ 3\times(Co+Ni)-2\times Cu \geqq 206\%;$$
$$Co+Ni+7\times Cu \leqq 130\%;\ 7\times(Co+Ni)+2\times Cu \leqq 581\%;$$
$$Mo+W+Nb+V+Cr+Ta \leqq 7\%;\ Ti+al+Zr+Hf \leqq 1.2\%;$$
$$C+Mn+Si \leqq 1\%;\ 80.5 \leqq Co+Ni+0.80\times Cu \leqq 81.7\%.$$

6 Claims, No Drawings

IRON-NICKEL ALLOY FOR STRETCHED SHADOW MASK

BACKGROUND OF THE INVENTION

1. Field of the Invention

The present invention relates to the use of an alloy of the iron-nickel type. The invention alloy is particularly useful for the manufacture of a stretched shadow mask for a cathode-ray display tube.

2. Discussion of the Background

In order to improve the quality of the image obtained, cathode-ray display tubes for color televisions include a shadow mask consisting of a very thin metal foil perforated, by chemical etching, by a multitude of holes. Placed inside the tube close to the display screen, the shadow mask is used to ensure that the impact of the electron beam takes place at the desired points so that the image obtained is sharp. However, it is also used, or may be used, for magnetic screening so as to remove the perturbations caused by the Earth's magnetic field which distort the image.

In flat-screen television screens, the metal foil perforated with holes is held taut by a rigid frame. The strain imposed by tension make it possible to avoid distortions which would result from local heating caused by the impact of the electron beam. Such a shadow mask is therefore termed "stretched".

In order to withstand the tensile forces necessary, the shadow mask must be made of an alloy having high mechanical properties, in particular a tensile strength greater than 500 MPa. This alloy must also have suitable magnetic properties, especially a low coercive field, a high permeability and a high saturation induction, in order to act as an effective magnetic screen. The alloy must also have an expansion coefficient compatible with that of the frame which supports and tensions the shadow mask and must be able to be blackened by a surface treatment so as to increase its emissivity in order to limit its heating under the effect of high-energy electron beams. Finally, the alloy foil must be able to be easily etched by chemical etching, which requires it to be as thin as possible and as flat as possible.

In order to manufacture stretched shadow masks, aluminum-killed dead-soft steels (AK steels) are used. However, these steels have several drawbacks: their mechanical properties and their magnetic properties are insufficient to obtain, simultaneously, high tensile strength, good magnetic screening and good chemical etchability. Iron-nickel alloys are also used which contain, by weight, either approximately 79% or approximately 80% nickel, approximately 4% molybdenum, optionally from 0 to 2% of at least one element taken from vanadium, titanium, hafnium and niobium, the balance being iron and inevitable impurities such as carbon, chromium, silicon, sulphur, copper and manganese, the content of impurities not exceeding 1%. These alloys are used in the form of work-hardened cold-rolled sheets so as to have a tensile strength greater than 800 MPa.

In the course of the manufacture of a stretched shadow mask, the alloy is subjected to an anneal at a temperature of approximately 450° C. which makes it possible to obtain relatively high magnetic properties without degrading the tensile strength. The presence of vanadium, titanium, hafnium or niobium, makes it possible, by suitable surface treatment, to produce good blackening of the surface.

Unfortunately, these prior art alloys do not completely solve the problems caused by the Earth's magnetic field and, in order to prevent the images from being distorted, complicated and expensive electronic correction means must be used. The need for electronic correction is even greater the larger the size of the cathode-ray screen and the thinner the shadow mask, that is to say the easier to etch.

OBJECTS OF THE INVENTION

One object of the present invention is to remedy the above drawbacks of the prior art by providing an alloy of the iron-nickel type which can be used for the manufacture of sheets, foils and particularly a stretched shadow mask and which can act as a good magnetic screen, even for small thicknesses, and which makes it possible when acting as a shadow mask to obtain good-quality images without it being necessary to apply a correction using electronic means.

DETAILED DESCRIPTION OF THE INVENTION

The above objects are provided by an iron-nickel alloy having a chemical composition by weight based on total weight as follows:

$$69\% \leqq Ni \leqq 83\%$$

$$0\% \leqq Mo \leqq 7\%$$

$$0\% \leqq Cu \leqq 8\%$$

$$0\% \leqq Co \leqq 1.5\%$$

$$0\% \leqq W \leqq 7\%$$

$$0\% \leqq Nb \leqq 7\%$$

$$0\% \leqq V \leqq 7\%$$

$$0\% \leqq Cr \leqq 7\%$$

$$0\% \leqq Ta \leqq 7\%$$

$$0\% \leqq C \leqq 0.1\%$$

$$0\% \leqq Mn \leqq 1\%$$

$$0\% \leqq Si \leqq 1\%$$

$$0\% \leqq Ti \leqq 1.2\%$$

$$0\% \leqq Al \leqq 1.2\%$$

$$0\% \leqq Zr \leqq 1.2\%$$

$$0\% \leqq Hf \leqq 1.2\%$$

$$S \leqq 0.010\%$$

the substantial, preferably complete, balance being iron with the inclusion in all instances of impurities resulting from smelting, the chemical composition furthermore satisfying the following relationships:

$$Co+Ni+1.5\times Cu \geqq 79.5\%$$

$$3\times(Co+Ni)-2\times Cu \geqq 206\%$$

$$Co+Ni+7\times Cu \leqq 130\%$$

$$7\times(Co+Ni)+2\times Cu \leqq 581\%$$

$$Mo+W+Nb+V+Cr+Ta \leqq 7\%$$

$$Ti+Al+Zr+Hf \leqq 1.2\%$$

$$C+Mn+Si \leqq 1\%$$

$$80.5 \leqq Co+Ni+0.80 \times Cu \leqq 81.7\%$$

Preferably, the chemical composition of the alloy is as above and such that:

$$0.04\% \leqq Ti+Al+Zr+Nf \leqq 1.2\%$$

and it is further independently and collectively desirable that:

$$S<0.001\%.$$

The alloy of the invention is useful in the same manner as prior art iron-nickel alloys and is particularly useful as a shadow mask. The invention alloy has particularly excellent characteristics as a magnetic screen when:

$$Mo+W+Ti+Nb+Al+Si+V+Cr+Ta \leqq 100 \times e$$

where e is the thickness of the alloy in mm.

The present invention also relates to a sheet made of the alloy according to the invention and described above, smelted by vacuum induction and then electroslag-remelted before being rolled and then annealed (preferably in a tunnel furnace) at a temperature of between 800° C. and 1200° C. for a time of approximately 1 min (30 sec–1.5 min) and planished under tension, in such a way that the grain size is between 8 and 11 ASTM, the tensile strength is greater than or equal to 500 MPa, the texture index n is less than 2, the coercive field is less than or equal to 0.5 A/cm and the saturation induction is greater than or equal to 0.7 tesla.

Finally, the present invention also relates to a stretched shadow mask consisting of a foil, perforated with holes, cut up from a sheet of iron-nickel alloy in accordance with the invention and described above.

The inventors have discovered, unexpectedly, that a stretched shadow mask made of an iron-nickel alloy whose chemical composition comprises, preferably, from 69% to 83% by weight of nickel, from 0% to 8% by weight of copper, from 0% to 1.5% by weight of cobalt, from 0% to 7% by weight of at least one element taken from molybdenum, tungsten, niobium, vanadium, chromium and tantalum, and satisfies the relationships:

$$Co+Ni+1.5 \times Cu \geqq 79.5\%$$

$$3 \times (Co+Ni)-2 \times Cu \geqq 206\%$$

$$Co+Ni+7 \times Cu \leqq 130\%$$

$$7 \times (Co+Ni)+2 \times Cu \leqq 581\%$$

$$80.5 \leqq Co+Ni+0.80 \times Cu \leqq 81.7\%$$

$$Mo+W+Nb+V+Cr+Ta \leqq 7\%$$

acts as a shadow mask and magnetic screen, it not being necessary to use a device for electronically correcting the image in order to compensate for the effects of the Earth's magnetic field. This chemical composition range makes it possible to obtain, simultaneously, a tensile strength greater than or equal to 500 MPa, a thermal expansion coefficient close to (±10%) $13 \times 10^{-6}$/K, a high magnetic permeability and a low coercive field.

Cobalt is optional herein and replaces part of the nickel in a proportion of approximately 1% by wt. of cobalt for approximately 1% of nickel. Above 1.5%, cobalt has an unfavorable effect on the effectiveness of the magnetic screening function of the stretched shadow mask.

Molybdenum, tungsten, niobium, vanadium, chromium and tantalum improve magnetic permeability and decrease the coercive field, but, when the sum of the contents of these elements exceeds 7% by wt. the alloy loses its magnetic properties and, furthermore, becomes much more difficult to hot roll and to cold roll.

In order to improve the emissivity of the shadow mask, one or more elements taken from titanium, aluminum, zirconium and hafnium may be added to the alloy in contents such that the Ti+Al+Zr+Hf sum is greater than or equal to 0.04% by wt. and less than or equal to 1.2% by wt. These alloys promote the formation, on the surface of the shadow mask, of a thin layer of black oxides which improves the emissivity and limits the heating of the shadow mask when it is being used. The sum of the contents of these elements is preferably greater than or equal to 0.04%, in order for there to be clear oxidation, but should remain less than or equal to 1.2% since, above this, rolling is very difficult.

The composition range of the invention alloy makes it possible to obtain alloys having a saturation induction $B_s$ of between approximately 0.5 and approximately (±10%) 1 tesla.

In order to make it possible to decrease the thickness of the invention alloy and, particularly, shadow mask, which thinning facilitates perforation by chemical etching, while at the same time maintaining magnetic screening, it is desirable that the invention alloy have a saturation induction $B_s$ greater than 0.7 tesla and preferably greater than 0.8 tesla. In order to do this, the contents of the elements such as molybdenum, tungsten, titanium, niobium, aluminum, silicon, vanadium, chromium and tantalum must be limited. Preferably, the chemical composition is therefore be such that:

$$Mo+W+Ti+Nb+Al+Si+V+Cr+Ta \leqq 3\% \text{ by wt.}$$

This is, in particular, the case when the thickness of the alloy or screen is less than or equal to 0.05 mm. More generally, this sum is preferably lower the lower the thickness. If e is the thickness expressed in millimeters, it is preferable that:

$$Mo+W+Ti+Nb+Al+Si+V+Cr+Ta \leqq 100 \times e.$$

In order to facilitate smelting and hot rolling, the alloy should contain between 0% and 0.1% (all %s are % by weight unless otherwise noted), preferably between 0% and 0.05%, of carbon, between 0% and 1%, and preferably between 0.2% and 0.6%, of manganese so as to fix the sulphur in order to obtain good hot plastic deformability and between 0% and 1%, and preferably between 0% and 0.3%, of silicon. However, in order to obtain a high saturation induction, the sum of the carbon, manganese and silicon contents should remain less than or equal to 1%.

The balance of the invention alloy composition preferably consists of iron and may include impurities resulting from smelting, such as phosphorus, sulphur, oxygen or nitrogen.

The sulphur content is preferably less than or equal to 0.01%. However, in order to obtain good quality perforation by chemical cutting, the sulphur content should more preferably remain less than or equal to 0.001%.

The best composition is:

$$80.5 \leqq Ni \leqq 81.5$$

$$2\% \leqq Mo \leqq 4\%$$

$Cu \leqq 0.2\%$ $0.2\% \leqq Mn \leqq 0.6\%$ $Si \leqq 0.1\%$ $0\% \leqq C \leqq 0.03\%$ $0.04\% \leqq Ti+Al+Zr+Hf \leqq 0.05\%$ $S < 0.001\%$ the balance being iron and impurities resulting from smelting.

One preferable method for the manufacture of a shadow mask is as follows: an alloy as defined hereinabove is smelted, preferably by vacuum induction melting (VIM) followed by electroslag remelting (ESR), in order to obtain a very clean metal, making it possible to obtain the best quality perforation by chemical etching.

The alloy thus smelted is cast as an ingot or in the form of a slab, then hot rolled and then cold rolled in order to obtain a thin sheet having a thickness of less than 0.20 mm and preferably less than 0.10 mm. Preferred shadow masks of the invention have thicknesses of from 0.001–1 mm, more preferably 0.004–0.25 mm.

The rolling is carried out in such a way that there is little texture and, in particular, in such a way that the texture index n is less than 2. This makes it possible to obtain a shadow mask whose properties are the same in all directions.

The texture index n is the maximum value of the ratio of the intensity of an x-ray beam reflected by a specimen of the sheet in question to the intensity of an x-ray beam reflected by an isotropic specimen consisting of the same alloy, the ratio being measured for all angles of incidence corresponding to each of the groups of theoretical textures.

By way of example, in order to manufacture a cold-rolled sheet having a thickness of approximately 0.05 mm, the procedure starts with a hot-rolled sheet whose thickness is between 4 and 5 mm. This sheet is cold rolled in several passes, interrupted by tunnel-furnace anneals, for example down to intermediate thicknesses of 2 mm, 0.25 mm and 0.08 mm. By proceeding in this way, the mechanical and magnetic anisotropies induced by the rolling are minimized.

After rolling, the sheet is subjected to a recrystallization anneal for example in a tunnel annealing furnace, at a temperature of between 800° C. and 1200° C. for a time of about 1 min. This anneal makes it possible to obtain a fine grain of a size between 8 ASTM and 11 ASTM, which is also necessary for the quality of chemical perforation. Finally, the sheet is planished under tension.

Planishing under tension causes a small plastic deformation of the sheet which has the effect of slightly degrading the permeability and the coercive field of the metal, but this planishing is essential in order to obtain perfect planarity in the sheet, necessary for the manufacture of shadow masks.

The sheet thus treated has a yield stress of 350 MPa, a tensile strength of 650 MPa, a coercive field $H_c$ of about 0.1 A/cm and a saturation induction $B_s$ greater than 0.7 tesla. It is important to note that, when the sheet is subjected to a tension of approximately 200 MPa the coercive field remains unchanged, at about 0.1 A/cm.

With the alloys according to the prior art, when the softened sheet is deformed by the operation of planishing under tension and then subjected to stresses, the magnetic properties are degraded more markedly than with the alloy according to the invention. As a result, the final coercive field is approximately three times higher and the permeability three times lower than with the alloy according to the invention.

EXAMPLES

By way of example, sheets were manufactured with five alloys according to the invention, identified as A, B, C, D and E, and two sheets identified as F and G, according to the prior art. The cold-rolled sheets had a thickness of 0.07 mm. They were all annealed in a tunnel furnace at 1050° C. for approximately 1 min.

The chemical compositions, expressed in per cent by weight, are given in Table 1.

TABLE 1

| % by weight | A | B | C | D | E | F | G |
|---|---|---|---|---|---|---|---|
| Ni | 81.1 | 80.8 | 77.0 | 80.9 | 81.0 | 79.7 | 77.0 |
| Mo | 5.80 | 5.55 | 3.90 | 2.90 | 0 | 4.95 | 3.20 |
| Cu | <0.01 | <0.01 | 5.50 | <0.01 | <0.01 | 0.04 | <0.01 |
| Mn | 0.50 | 0.50 | 0.50 | 0.60 | 0.30 | 0.40 | 0.40 |
| Si | <0.05 | <0.05 | 0.10 | 0.05 | 0.10 | 0.20 | 0.12 |
| C | 0.008 | 0.012 | 0.010 | 0.007 | 0.015 | 0.015 | 0.011 |
| Nb | 0 | 0 | 0 | 0 | 3.80 | 0 | 0 |
| Fe | balance | balance | balance | balance | balance | balance | balance |

The mechanical and magnetic properties, in the condition of being annealed and then lightly deformed by planishing and subjected to stresses are given in Table 2.

TABLE 2

| | A | B | C | D | E | F | G |
|---|---|---|---|---|---|---|---|
| Coercive field A/cm | 0.16 | 0.08 | 0.18 | 0.11 | 0.15 | 0.32 | 0.41 |
| Saturation induction, T | 0.7 | 0.7 | 0.7 | 0.85 | 0.8 | 0.75 | 0.9 |
| Relative permeability | 12000 | 36000 | 11000 | 19000 | 12000 | 4000 | 3000 |
| Yield stress, MPa | 340 | 345 | 320 | 350 | 390 | 362 | 295 |
| Load at break, MPa | 654 | 683 | 630 | 655 | 710 | 671 | 660 |
| Strain at break, % | 28 | 35 | 32 | 35 | 29 | 25 | 35 |
| Hardness, HV | 180 | 175 | 165 | 185 | 190 | 170 | 160 |

As shown above, alloys A,B,C,D and E according to the invention have the lowest coercive fields and the highest permeabilities. Alloys F and G according to the prior art have poorer coercive fields and permeabilities, by a ratio of 2 to 3.

A 30 cm×22 cm stretched shadow mask 0.12 mm in thickness, which required no electronic correction for the defects caused by the Earth's magnetic field, was manufactured using sheet B.

This application is based on French patent application 95 08642 filed Jul. 18, 1995, incorporated herein by reference.

What is claimed as new and desired to be secured by Letters Patent of the United States is:

1. A stretched shadow mask comprising an alloy whose chemical composition comprises, by weight based on total weight:

$72.4\% \leqq Ni \leqq 81.7\%$ $0\% \leqq Mo \leqq 7\%$ $0\% \leqq Cu \leqq 8\%$ $0\% \leqq Co \leqq 1.5\%$ $0\% \leqq W \leqq 7\%$ $0\% \leqq Nb \leqq 7\%$ $0\% \leqq V \leqq 7\%$ $0\% \leqq Cr \leqq 7\%$ $0\% \leqq Ta \leqq 7\%$ $0\% \leqq C \leqq 0.1\%$ $0\% \leqq Mn \leqq 1\%$ $0\% \leqq Si \leqq 1\%$ $0\% \leqq Ti \leqq 1.2\%$ $0\% \leqq Al \leqq 1.2\%$ $0\% \leqq Zr \leqq 1.2\%$ $0\% \leqq Hf \leqq 1.2\%$ $S \leqq 0.010\%$ the balance being iron and impurities resulting from smelting, the chemical composition furthermore satisfying the following relationships:

$7 \times (Co+Ni)+2 \times Cu \leqq 581\%$ $Mo+W+Nb+V+Cr+Ta \leqq 7\%$ $Ti+Al+Zr+Hf \leqq 1.2\%$ $C+Mn+Si \leqq 1\%$ $80.5 \leqq Co+Ni+0.80 \times Cu \leqq 81.7\%$.

2. The stretched shadow mask according to claim 1, wherein:

$0.04\% \leqq Ti+Al+Zr+Hf \leqq 1.2\%$.

3. The stretched shadow mask according to claim 1, wherein:

$S < 0.001\%$.

4. The stretched shadow mask according to claim 1, wherein:

$Mo+W+Ti+Nb+Al+Si+V+Cr+Ta \leqq 100 \times e$ wherein e is the thickness of the mask in mm.

5. The stretched shadow mask according to claim 1 consisting of a foil perforated with holes, said foil consisting of said alloy which has been smelted by vacuum induction and then electroslag remelted before being rolled and then annealed in a tunnel furnace at a temperature of between 800° C. and 1200° C. for a time of from 30 sec to 1.5 min and planished under tension, and wherein the grain size of said alloy is between 8 and 11 ASTM, the tensile strength is greater than or equal to 500 MPa, the texture index n is less than 2, the coercive field is less than or equal to 0.3 A/cm and the saturation induction is greater than or equal to 0.7 tesla.

6. The stretched shadow mask according to claim 1 whose chemical composition is as follows:

$80.5 \leqq Ni \leqq 81.5$ $2\% \leqq Mo < 4\%$ $Cu \leqq 0.2\%$ $0.2\% \leqq Mn \leqq 0.6\%$ $Si \leqq 0.1\%$ $0\% \leqq C \leqq 0.03\%$ $0.4\% \leqq Ti+Al+Zr+Hf \leqq 0.05\%$ $S < 0.001\%$ the balance being iron and impurities resulting from smelting.

* * * * *